United States Patent [19]

Piotrowski

[11] Patent Number: 5,056,802

[45] Date of Patent: Oct. 15, 1991

[54] STEP ACTION WHEEL SKATE

[76] Inventor: Zygmunt Piotrowski, 4 M. 48, UL. Keniga, Warsaw, Poland

[21] Appl. No.: 562,622

[22] Filed: Aug. 3, 1990

[30] Foreign Application Priority Data

Apr. 6, 1990 [PL] Poland ..... 284665

[51] Int. Cl.[5] ..... A63C 17/12; B62M 1/04

[52] U.S. Cl. ..... 280/11.115; 280/221

[58] Field of Search ..... 280/11.115, 220, 221, 280/253, 254, 252

[56] References Cited

U.S. PATENT DOCUMENTS

| | | | |
|---|---|---|---|
| 581,453 | 4/1897 | Boldt | 280/11.115 |
| 873,889 | 12/1907 | Palmer | 280/11.115 |
| 903,525 | 11/1908 | Wellnitz | 280/11.115 |
| 1,070,168 | 8/1913 | Nordling | 280/11.115 |
| 1,150,966 | 8/1915 | Ries | 280/11.115 |
| 4,417,737 | 11/1983 | Suroff | 280/11.115 |
| 4,451,005 | 5/1984 | Lee | 280/11.115 X |

FOREIGN PATENT DOCUMENTS 91063 7/1977 Poland .

*Primary Examiner*—Andres Kashnikow
*Assistant Examiner*—Michael Mar
*Attorney, Agent, or Firm*—Fleit, Jacobson, Cohn, Price, Holman & Stern

[57] ABSTRACT

A wheel skate is provided including a small diameter front wheel journaled for rotation about an horizontal transverse axis immediately beneath the toe end of the shoe of the skate and a larger diameter rear driving wheel is provided and journaled for rotation about a second axis generally paralleling the first mentioned axis. The rear driving wheel is journaled from the lower portions of depending opposite side frames each mounted from the skate for guided movement longitudinally thereof between front and rear limit positions and the rear driving wheel includes a spur gear drivingly connected to the rear driving wheel through a one way over-running clutch and the spur gear is mesh engaged with a rack gear extending longitudinally of the skate and along which the spur gear may roll during front to rear shifting of the frames relative to the skate. The positioning of the small diameter front wheel immediately beneath the toe of the shoe or boot of the skate and the rearmost limit position of the rear driving wheel of the skate enables up and down movement of the heel end of the skate by the wearer with minimum effort to propel the skate forwardly in a efficient manner.

11 Claims, 1 Drawing Sheet

STEP ACTION WHEEL SKATE

BACKGROUND OF THE INVENTION

1. Field of the Invention

This invention relates to a wheel skate incorporating a rear drive wheel as well as a front wheel and wherein the wearer of a pair of the wheel skates may propel himself or herself forwardly merely by alternately raising and forcing downwardly the heel portions of the shoes of the skates.

2. Description of Related Art

Various different forms of wheel skates provided with rack and spur gear propelled rear driving wheels heretofore have been provided such as those disclosed in U.S. Pat. Nos. 581,453, 1,070,168 1,150,966 and 4,417,737. In addition, a further wheel skate of generally the same type is disclosed in Polish Patent No. 1,063.

However, these previously known forms of wheel skates do not include rear wheel driving mechanisms equivalent to the rear wheel driving mechanism of the instant invention, nor do they include the front and rear wheel positioning of the instant invention, which positioning is an important advantage in providing a wheel skate of this type which may be relatively effortlessly used.

SUMMARY OF THE INVENTION

The wheel skate of the instant invention utilizes a rear wheel driving mechanism which incorporates one way driving clutches and further utilizes a rack and pinion gear arrangement designed to afford maximum forward movement of the wheel skate during each forward thrust developing phase of operation of the wheel skate.

In addition, the wheel skate includes a small journaled front wheel whose axis of rotation is disposed substantially vertically beneath the forward of the toe end of the shoe of the skate and a larger rear drive wheel which is shiftable between a forwardmost position spaced closely rearward of the front wheel and a rearmost position with the axis of rotation of the rear wheel disposed vertically beneath the heel end of the skate shoe. This positioning of the front and rear skate wheels enables the toe of the boot to pivot naturally about the axis of the small front wheel when the heel of the boot is being raised between power strokes and also enables downward heel force by the skate user to be more effectively and efficiently converted into a forward rotation driving force of the skate rear wheel.

The main object of this invention is to provide a wheel skate constructed in a manner whereby the user thereof may propel himself or herself forwardly merely by alternately raising and transferring weight downwardly upon the heel end of the associated skate shoe.

Another object of this invention, in accordance with the immediately preceding object, is to provide a wheel skate designed to provide a forward driving force to the rear driving wheel of the skate through a maximum degree of rotation of the rear driving wheel in response to minimum vertical shifting of the heel end of the skate shoe.

Another important object of this invention is to provide a wheel skate which may be effectively utilized by the user merely as a result of the user alternately raising and lowering the heel end portions of the skate shoes and with only minimum raising of the toe portions of the skate shoes.

A final object of this invention to be specifically enumerated herein is to provide a wheel skate in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 3:
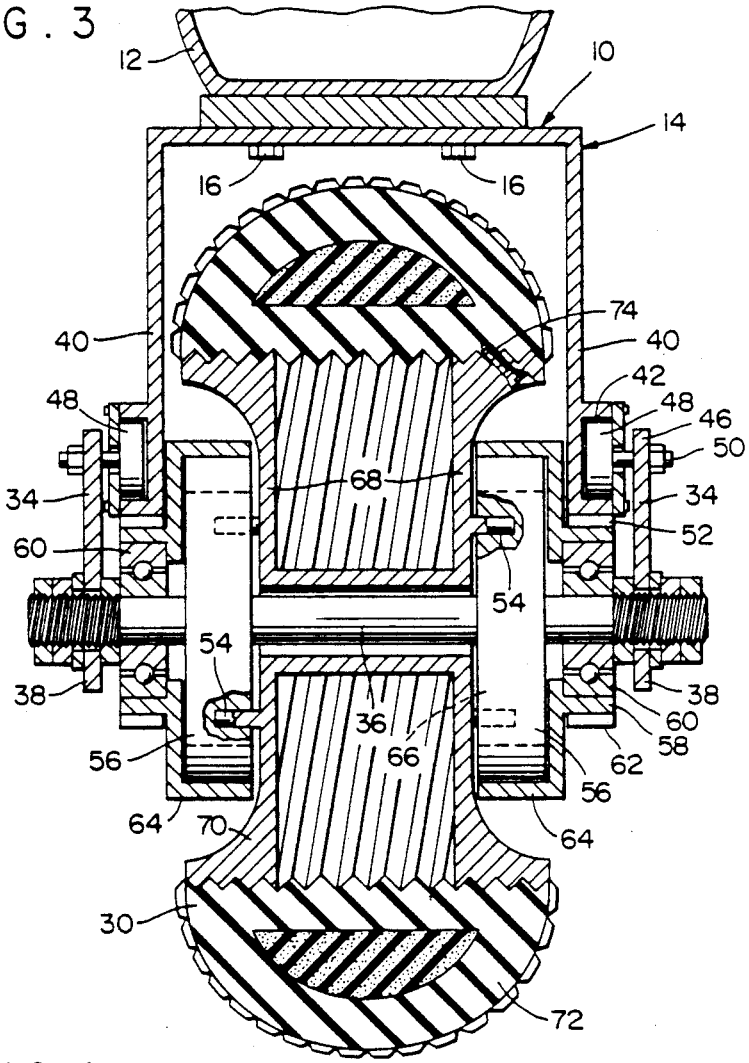
FIG. 3 is an enlarged fragmentary transverse sectional view taken substantially upon the plane indicated by the section line 3—3 of FIG. 2.

Referring now more specifically to the drawings the numeral 10 generally designates the wheel skate of the instant invention. The wheel skate 10 includes a shoe (or boot) 12 of conventional design mounted upon a generally channel shaped frame 14 through the utilization of suitable fasteners 16.

The shoe includes toe and heel ends 18 and 20 and the frame includes front and rear ends 22 and 24. The frame is elongated and extends longitudinally of the shoe with the toe and heel ends 18 and 20 of the shoe 12 disposed over the front and rear ends 22 and 24, respectively, of the frame 14.

A first small diameter wheel assembly 26 is journaled from the front end 22 for rotation about a first horizontal axis extending transversely of the frame 14 and the axis 28 is disposed substantially vertically beneath the toe end 18.

A second larger diameter wheel assembly 20 is provided and journaled for rotation about a second horizontal axis 32 substantially paralleling the first axis 28 and the second wheel assembly 30 is journaled from a support assembly or support means including a pair of opposite side depending support frames 34. The support frames 34 are generally right triangular in configuration and the opposite ends of an axle 36 defining the second axis 32 is secured between the lower apex portions 38 of the frames 34.

The frame 14 is generally inverted U-shaped configuration in transverse cross-section including a pair of depending opposite side plates 40 and the lower marginal portions of the plates 40 define guide tracks 42 extending longitudinally of the frame 14. The upper apex portions 44 and 46 of the support frames 34 include follower rollers 48 journaled therefrom as at 50 and the follower rollers 48 are guidingly received in the guide tracks 42 for movement therealong between forwardmost and rearmost limit positions.

The lower marginal edges of the opposite side plates 40 include rack gear teeth 52 spaced longitudinally therealong and the wheel assembly 30 is removably pinned to and supported between, as at 54, a pair of opposite side one way over-running clutch assemblies 56. The clutch assemblies 56 include diametrically reduced outer end portions 58 journaled from the axle 36 by bearings 60 and including outer peripheral spur gear teeth 62 mesh engaged with the rack gear teeth 52.

The clutch assemblies 56 each include outer peripheral portions 64 formed integrally with the diametrically reduced portions 58 and inner peripheral portions 66 journaled from the outer peripheral portions 64 and which are pinned to opposite axial ends 68 of the rim 70 of the wheel assembly 30 at 54. The outer periphery of the rim 70 is provided with external threads and the complementary threaded inner periphery of an annular tire 72 is threaded on the outer periphery of the rim 70, a set screw removably threadingly supported from the rim 70 and engaged with the tire 72 preventing relative rotation between the tire 72 and the rim 70.

Figure 1:
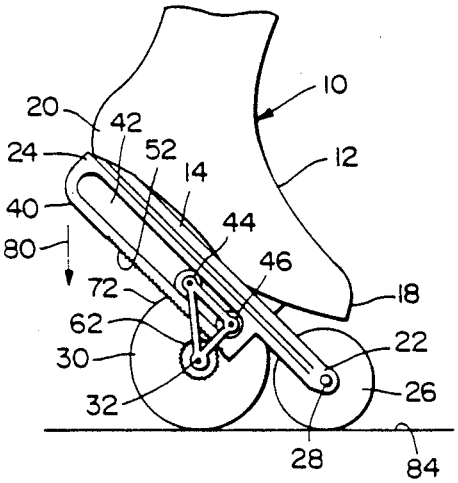
FIG. 1 is a schematic side elevational view of the wheel skate with the heel portion thereof raised preparatory to a downward thrust being applied to the heel end portion of the skate shoe in order to propel the skate forward.

The clutch assemblies 56 may be of any suitable type such that clockwise rotation of the spur gear teeth 62 illustrated in FIG. 1 will impart clockwise rotation to the tire 72 and the tire 72 illustrated in FIG. 1 will be capable of over-running the spur gear teeth 72 in a clockwise direction.

Figure 2:
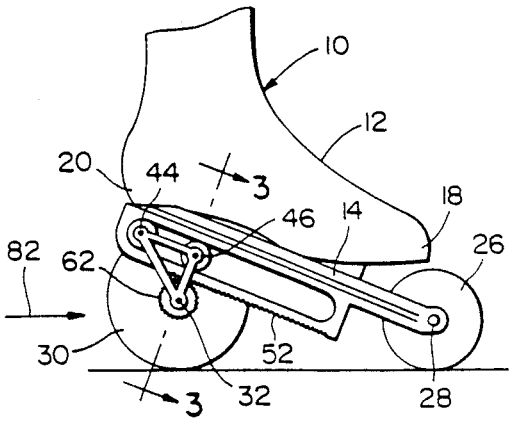
FIG. 2 is a schematic side elevational view of the skate shoe with the heel portion thereof in the fully lowered position at the end of the forward thrust generated to the rear driving wheel of the skate during downward movement of the heel portion of the skate shoe from the position thereof illustrated in FIG. 1.

With attention invited more specifically to FIGS. 1 and 2, assuming that the shoe 12 of the skate 10 is positioned as illustrated in FIG. 1, the heel end 20 of the shoe 12 has been raised and the opposite side plates 40 are forwardly and downwardly inclined such that the weight of the support frames 34, the wheel assembly 30, the clutch assemblies 56, the axle 36 and the bearings 60 cause the support frames 34 to move downwardly along the guide tracks 42 until the forwardmost rollers 48 engage the forward ends of the tracks 42. Then, as downward force is applied by the heel end 20 of the shoe 12 in the direction of the arrow 80, the rack gear teeth 52 move downwardly over the upper peripheral portion of the spur gear teeth 62 and cause forward (clockwise) rotation of the wheel assembly 30 and thereby cause forward movement of the skate 10 in the direction of the arrow 82 in FIG. 2. It will be noted that downward pressure in the direction of the arrow 80 substantially parallels a transverse plane containing the axis of rotation of the rearmost roller 48 and the axis 32 of the wheel assembly 30 at the point of initial downward movement of the heel end 20 of the shoe 12 and that downward pressure in the direction of the arrow 80 at the end of the downward stroke generally bisects the angle defined between the axis 32 and the axes of rotation of the rear and front rollers 48. In this manner, the downward force in the direction of the arrow 80 is more efficiently transformed into forward rotation of the wheel assembly 30. Also, inasmuch as the toe end 18 of the shoe 12 closely over lies the smaller diameter front wheel assembly 26 and is disposed substantially vertically above the axis 28, as the heel end 20 of the shoe 12 is raised from the position thereof illustrated in FIG. 2 to the position thereof illustrated in FIG. 1, the toe end 18 is merely angularly displaced less than 30 degrees about the axis 28 and is only slightly elevated relative to the horizontal surface 84 upon which the wheel assemblies 26 and 30 rest as the shoe 12 is shifted from the position thereof illustrated in FIG. 2 to the position thereof illustrated in FIG. 1. In this manner, the user of the skate 10 is required to lift less than one-half the weight of the skate 10 when raising the heel end 20 from the position of FIG. 2 to the position thereof illustrated in FIG. 1 and this lifting movement substantially duplicates the type of movement encountered when a person wearing shoes or boots with stiff soles rotates up onto the toe portions of the soles.

It is also pointed out that inasmuch as the spur gear teeth 62 are disposed radially outwardly only of the bearings 60 and not radially outwardly of the clutch assemblies 56, the spur gear teeth 62 may be of quite small diameter. In this manner, maximum angular displacement of the wheel assembly 30 is effected each time the spur gear teeth 62 move rearwardly along the rack gear teeth 52.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A step action wheeled shoe skate including an elongated frame having front and rear ends, a shoe having toe and heel ends, mounting means mounting said shoe from said frame with said shoe overlying and extending longitudinally of said frame and said toe and heel ends disposed over said front and rear ends, respectively, a first wheel assembly journaled from said front end for rotation about a first axis extending transversely of said frame and shoe and disposed substantially vertically beneath said toe end, a second wheel assembly, support means for said second wheel assembly from which said wheel assembly is journaled for rotation about a second axis substantially paralleling said first axis, said support means and frame including coacting guide means mounting said support means from said frame for shifting therealong between a forward limit position with said second wheel assembly closely rearward of said first wheel assembly and a rearward limit position with said second axis disposed generally vertically beneath said heel end, said guide means including a rack gear extending lengthwise along said frame, said wheel assembly including a spur gear rollingly engaged with said rack gear and one way clutch means drivingly connecting said spur gear to said second wheel assembly for forward rotation of the latter with said spur gear as said spur gear rolls rearwardly along said rack gear and allowing continued forward rotation of said rear wheel assembly relative to said spur gear as the latter rolls forwardly along said rack gear, said coacting guide means including an elongated guide track extending along each side of said frame and a pair of depending support frames each including a pair of followers guidingly engaged with the corresponding guide track at points spaced longitudinally therealong, said pairs of followers being carried by upper portions of the corresponding depending support frames and said second axis being stationarily mounted relative to and extending between lower portions of said support frames.

2. The shoe skate of claim 1 wherein the forward followers of said pairs of followers and said second axis lie in a first plane substantially normal to said rack gear and the rearward followers and said second axis lie in a second rearwardly and upwardly inclined plane when said second wheel assembly is in the rear limit position thereof and said second plane is substantially vertically disposed when said second wheel assembly is in its forward limit position.

3. The shoe skate of claim 2 wherein said pairs of followers each include a pair of rollers journaled from the corresponding depending support frame and rollingly engaged with the corresponding guide track.

4. A step action wheeled shoe skate including an elongated frame having front and rear ends, a shoe having toe and heel ends, mounting means mounting said shoe from said frame with said shoe overlying and extending longitudinally of said frame and said toe and heel ends disposed over said front and rear end, respectively, a first wheel assembly journaled form said front end for rotation about a first axis extending transversely of said frame and shoe and disposed substantially vertically beneath said toe end, a second wheel assembly, support means for said second wheel assembly from which said wheel assembly is journaled for rotation about a second axis substantially paralleling said first axis, said support means and frame including coacting guide means mounting said support means for said frame for shifting therealong between a forward limit position with said second wheel assembly closely rearward of said first wheel assembly and a rearward limit position with said second axis disposed generally vertically beneath said heel end, said guide mans including a rack gear extending lengthwise along said frame, said wheel assembly including a spur gear rollingly engaged with said rack gear and one way clutch means drivingly connecting said spur gear to said second wheel assembly for forward rotation of the latter with said spur gear as said spur gear rolls rearwardly along said rack gear and allowing continued forward rotation of said rear wheel assembly relative to said spur gear as the latter rolls forwardly along said rack gear, said guide means including a pair of rack gears on opposite sides of said second wheel assembly and said second wheel assembly includes corresponding opposite side spur gears rollingly meshed engaged with said rack gears as well as a pair of opposite side one way clutch means each providing a one way drive connection of the corresponding spur gear with said second wheel assembly, said clutch means and spur gears being spaced apart longitudinally of said second axis, said clutch means being spaced between said spur gears and the diameters of said spurs gears are considerably less than the diameters of said clutch means, said coacting guide means including an elongated guide track extending along each side of said frame and a pair of depending support frames each including a pair of followers guidingly engaged with the corresponding guide track at points spaced longitudinally therealong, said pairs of followers being carried by upper portions of the corresponding depending support frames and said second axis being stationarily mounted relative to and extending between lower portions of said support frames.

5. The shoe skate of claim 4 wherein the forward followers of said pairs of followers and said second axis lie in a first plane substantially normal to said rack gear and the rearward followers and said second axis lie in a second rearwardly and upwardly inclined plane when said second wheel assembly is in the rear limit position thereof and said second plane is substantially vertically disposed when said second wheel assembly is in its forward limit position.

6. The shoe skate of claim 5 wherein said guide means includes a pair of rack gears on opposite sides of said second wheel assembly and said second wheel assembly includes corresponding opposite spur gears rollingly meshed engaged with said rack gears as well as a pair of opposite side one way clutch means each providing a one way drive connection of the corresponding spur gear with said second wheel assembly, said clutch means and spur gears being spaced apart longitudinally of said second axis.

7. The shoe skate of claim 5 wherein said pairs of followers each include a pair of rollers journaled from the corresponding depending support frame and rollingly engaged with the corresponding guide track.

8. The shoe skate of claim 7 wherein said clutch means are spaced between said spur gears and the diameters of said spur gears are considerably less than the diameters of said clutch means.

9. A step action wheeled shoe skate including an elongated frame having front and rear ends, a shoe having toe and heel ends, mounting means mounting said shoe from said frame with said shoe overlying and extending longitudinally of said frame and said toe and heel ends disposed over said front and rear end, respectively, a first wheel assembly journaled from said front end for rotation about a first axis extending transversely of said frame and shoe, a second wheel assembly, support means for said second wheel assembly from which said second wheel assembly is journaled for rotation about a second axis substantially paralleling said first axis, said support means and frame including coacting guide means mounting said support means from said frame for shifting therealong between a forward limit position with said second wheel assembly being closely rearward of said first wheel assembly and a rearward limit position with said second axis disposed generally vertically beneath said heel, said guide means including a rack gear extending lengthwise along said frame, said second wheel assembly including a spur gear rollingly engaged with said rack gear and one way clutch means drivingly connecting said spur gear to said second wheel assembly for permitting forward rotation of the latter with said spur as said spur gear rolls rearwardly along said rack gear and allowing continued forward rotation of said rear wheel assembly relative to said spur gear as the latter rolls forwardly along said rack gear, said coacting guide means including an elongated guide track extending along each side of said frame and a depending support frame including a pair of followers guidingly engaged with each guide track at points spaced longitudinally therealong, said pairs of followers being carried by upper portions of the corresponding depending support frames and said second axis being stationarily mounted relative to and extending between lower portions of said support frames, the forward followers of said pairs of followers and said second axis lying in a first plane substantially normal to said rack gear and the rearward followers and said second axis lying in a second rearwardly and upwardly inclined plane when said second wheel assembly is the rear limit position thereof, said second plane being substantially vertically disposed when said second wheel assembly is in its forward limit position.

10. A step action wheel ed shoe skate including an elongated main frame having an upper surface and a lower surface, a shoe mounted on said upper surface, a front wheel journaled from a forward end of said main frame and a rear driving wheel journaled from said main frame upon a transverse axle, said rear driving wheel being coupled through one way clutches with gear wheels carried by said transverse axle, said gear wheels being in mesh engagement with rack gears mounted from and extending along opposite sides of the lower surface of said main frame, said main frame including side guide tracks extending along opposite sides of said main frame, in each of which guide tracks a pair of front and rear follower rollers are received for rolling engagement therein, each pair of rollers being journaled from front and rear portions respectively of a corresponding wheel support frame located along a respective side of said main frame, each said wheel support frame including a depending portion from which the corresponding end of said axle is supported.

11. The shoe skate of claim 10 wherein said guide tracks are defined by elongated, depending opposite side plate portions of said frame from and along which said rack gears are supported and extend.

* * * * *